US008559652B2

(12) United States Patent
Hwang

(10) Patent No.: US 8,559,652 B2
(45) Date of Patent: Oct. 15, 2013

(54) APPARATUS AND METHOD FOR REMOVING WHITE NOISE IN PORTABLE TERMINAL

(75) Inventor: Jung-Eun Hwang, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 663 days.

(21) Appl. No.: 12/760,681

(22) Filed: Apr. 15, 2010

(65) Prior Publication Data

US 2010/0272288 A1 Oct. 28, 2010

(30) Foreign Application Priority Data

Apr. 22, 2009 (KR) ..... 10-2009-0034899

(51) Int. Cl.
*G10L 21/0208* (2013.01)

(52) U.S. Cl.
CPC ..... *G10L 21/0208* (2013.01)
USPC ..... 381/94.1; 381/94.2; 381/94.3

(58) Field of Classification Search
USPC ..... 381/94.1, 94.2, 94.3
See application file for complete search history.

(56) References Cited

U.S. PATENT DOCUMENTS

2006/0217068 A1* 9/2006 Angelopoulos ..... 455/63.1
2007/0237339 A1* 10/2007 Konchitsky ..... 381/91

* cited by examiner

*Primary Examiner* — Duc Nguyen
*Assistant Examiner* — George Monikang
(74) *Attorney, Agent, or Firm* — Cha & Reiter, LLC

(57) ABSTRACT

A method and an apparatus for removing white noise in a portable terminal are provided. The method for removing the white noise in the portable terminal includes measuring a volume variation of a voice signal output from a power amplifier; detecting a frequency band including white noise using the measured volume variation; and removing signals of the detected frequency band in the voice signal before output to speaker.

3 Claims, 2 Drawing Sheets

APPARATUS AND METHOD FOR REMOVING WHITE NOISE IN PORTABLE TERMINAL

CLAIM OF PRIORITY

The present application claims the benefit under 35 U.S.C. §119(a) to a Korean patent application filed in the Korean Intellectual Property Office on Apr. 22, 2009 and assigned Ser. No. 10-2009-0034899, the entire disclosure of which is hereby incorporated by reference.

BACKGROUND OF THE INVENTION

1. Field of the Invention

The present invention relates generally to an apparatus and a method for removing white noise in a portable terminal. More particularly, the present invention relates to an apparatus and a method for removing white noise from a voice signal.

2. Description of the Related Art

When a user of a portable terminal conducts voice communication, voice of the other user is often distorted or hard to hear because of various noises in surroundings. To improve the communication between the users, conventional portable terminals provide diverse schemes for removing the noise during the exchange of voice signals.

In particular, one conventional method removes white noise in the received voice signal by lowering the volume of the received voice signal or controlling a receive filter. However, this method decreases the volume of the received voice signal which in turn deteriorates the tone quality and/or interferes with the volume tuning of the portable terminal.

SUMMARY OF THE INVENTION

An aspect of the present invention to provide an apparatus and a method for removing white noise in a portable terminal.

Another aspect of the present invention is to provide an apparatus and a method for detecting and removing a frequency band of white noise using the volume variation of a voice signal in a portable terminal.

Yet another aspect of the present invention is to provide an apparatus and a method for removing white noise from a received voice signal at a speaker level of a portable terminal.

According to one aspect of the present invention, a method for removing white noise in a portable terminal includes measuring a volume variation of a voice signal output from a power amplifier; detecting a frequency band including white noise using the measured volume variation; and removing signals of the detected frequency band in the voice signal before output to speaker.

According to another aspect of the present invention, an apparatus for removing white noise in a portable terminal includes a noise band detector for measuring a volume variation of a voice signal output from a power amplifier and detecting a frequency band including white noise using the measured volume variation; and a noise remover for removing signals of the detected frequency band in the voice signal before output to speaker.

Other aspects, advantages, and salient features of the invention will become apparent to those skilled in the art from the following detailed description, which, taken in conjunction with the annexed drawings, discloses exemplary embodiments of the invention.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Throughout the drawings, like reference numerals will be understood to refer to like parts, components and structures.

DETAILED DESCRIPTION OF THE INVENTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

Hereinafter, exemplary embodiments of the present invention provide an apparatus and a method for detecting a frequency band of white noise using volume variation of a voice signal and removing a voice signal of the detected frequency band at a speaker stage of a portable terminal. Hereinafter, a received voice signal is exemplified, but it should be noted that the teachings of the present invention can be equally applied to a transmit voice signal.

Figure 1:
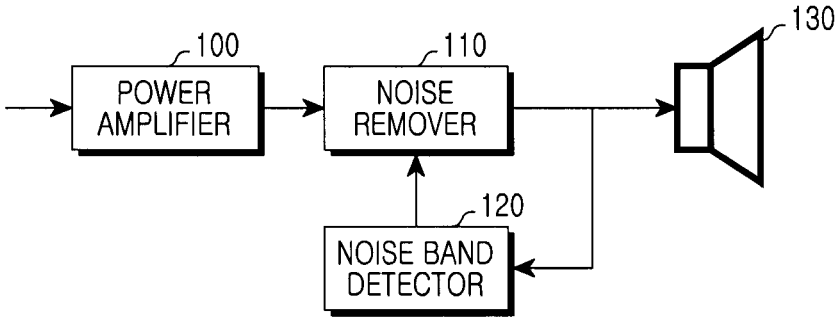
FIG. 1 is a block diagram of a portable terminal according to an exemplary embodiment of the present invention.

FIG. 1 is a block diagram of a portable terminal according to an exemplary embodiment of the present invention.

Referring to FIG. 1, the portable terminal includes a power amplifier 100, a noise remover 110, a noise band detector 120, and a speaker 130.

The power amplifier 100 amplifies the power of the input voice signal according to a preset scheme and outputs the amplified voice signal to the noise remover 110.

The noise remover 110 removes white noise from the voice signal output from the power amplifier 100 using frequency band information fed from the noise band detector 120. That is, the noise remover 110 removes the white noise from the voice signal output from the power amplifier 100 by removing signals fed from the noise band detector 120.

Herein, the noise remover 110 can employ a filter which filters signals of a particular frequency band and passes only other frequency band signals. For example, upon receiving the frequency band information corresponding to the white noise from the noise band detector 120, the noise remover 110 removes the signals that matches the received frequency band and passes other frequency band signals via the filter, thus removing the white noise from the voice signal.

The noise band detector 120 detects the frequency band of the white noise by measuring the magnitude that is, the volume of the voice signal output from the noise remover 110 to the speaker 130 during a certain time duration. In more detail, after measuring the volume of the voice signal during the certain time duration, the noise band detector 120 detects a frequency band where the variation of the volume measured for the certain time falls below a preset threshold, and determines the corresponding frequency band as the interval including the white noise. Upon detecting the frequency band including the white noise, the noise band detector 120 provides information of the detected frequency band to the noise remover 110. The white noise at the output of a speaker mostly exhibits a constant magnitude without a variation in the volume. Based on this characteristic, the present invention determines the frequency band including the white noise by detecting the volume variation of the voice signal output to the speaker 130.

Figure 2:
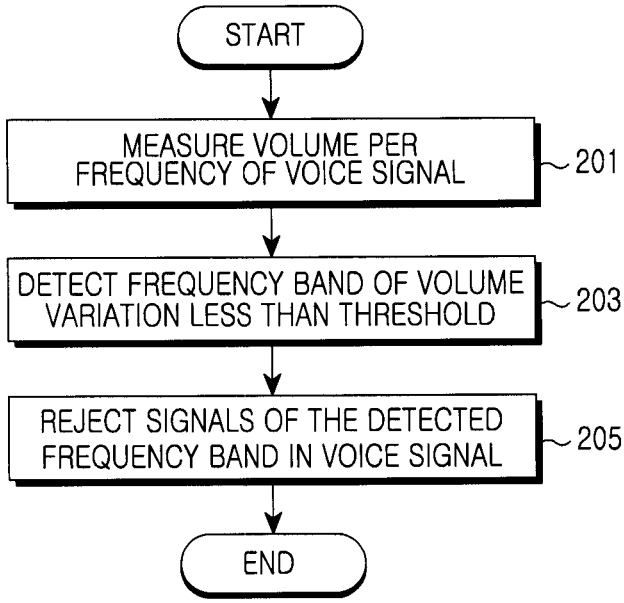
FIG. 2 is a flowchart of a method for removing white noise in the portable terminal according to an exemplary embodiment of the present invention.

FIG. 2 is a flowchart of a method for removing the white noise in the portable terminal according to an exemplary embodiment of the present invention.

Referring to FIG. 2, in step 201 ("Measure volume per frequency of voice signal"), the portable terminal measures the volume of the voice signal output from the power amplifier to the speaker for a certain time period. The portable terminal detects the frequency band where the variation of the volume detected during this time period falls below the preset threshold in step 203 ("Detect frequency band of volume variation less than a threshold"), and if so, determines the detected frequency band as the white noise interval.

In step 205, the portable terminal removes the white noise from the voice signal at the speaker stage by removing signals corresponding to the detected frequency band in the voice signal output to the speaker. Upon detecting the frequency band of the white noise, the portable terminal removes the signals of the determined frequency band associated with the white noise and passes other frequency signals by controlling the filtering frequency band of the filter.

Next, the portable terminal finishes this process.

After detecting the frequency band including the white noise by detecting volume variation of the voice signal at the speaker stage of the portable terminal, the signals of the detected frequency band can be removed from the voice signal as described above. As a result, the white noise can be removed without decreasing the volume of the voice signal.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method for removing white noise in a portable terminal, comprising:

detecting a volume variation, at each of a plurality of frequencies, of a voice signal output from a power amplifier;

detecting a frequency band of the voice signal comprising white noise to be removed, by comparing the volume variation during a certain time interval with a preset threshold value, and when the volume variation is less than the preset threshold, detecting a corresponding frequency band of that volume variation as the frequency band comprising the white noise to be removed; and removing signals that match the detected frequency band from the voice signal before output to a speaker.

2. An apparatus for removing white noise in a portable terminal, comprising:

a noise band detector for measuring a volume variation, at each of a plurality of frequencies, of a voice signal output from a power amplifier, and detecting a frequency band of the voice signal comprising white noise to be removed by comparing the volume variation during a certain time interval with a preset threshold value, and when the volume variation is less than the preset threshold, detecting a corresponding frequency band of that volume variation as the frequency band comprising the white noise to be removed and a noise remover for removing signals of the detected frequency band from the voice signal before output to a speaker.

3. A portable terminal comprising:

an apparatus for removing white noise, the apparatus including:

a noise band detector for measuring a volume variation, at each of a plurality of frequencies, of a voice signal output from a power amplifier, and detecting a frequency band of the voice signal comprising white noise to be removed by comparing the volume variation during a certain time interval with a preset threshold value, and when the volume variation is less than the preset threshold, detecting a corresponding frequency band of that volume variation as the frequency band comprising the white noise to be removed; and a noise remover for removing signals of the detected frequency band from the voice signal before output to a speaker.

* * * * *